US008702566B2

(12) United States Patent
Mazzanobile et al.

(10) Patent No.: US 8,702,566 B2
(45) Date of Patent: Apr. 22, 2014

(54) SPEED AND/OR AGILITY TRAINING DEVICES AND SYSTEMS AND METHODS FOR USE THEREOF

(76) Inventors: Paul Mazzanobile, Surf City, NJ (US); Evan Baumgarten, Wyckoff, NJ (US)

( * ) Notice: Subject to any disclaimer, the term of this patent is extended or adjusted under 35 U.S.C. 154(b) by 168 days.

(21) Appl. No.: 13/339,805

(22) Filed: Dec. 29, 2011

(65) Prior Publication Data

US 2012/0190501 A1 Jul. 26, 2012

Related U.S. Application Data

(63) Continuation-in-part of application No. 13/163,476, filed on Jun. 17, 2011, which is a continuation of application No. 12/646,899, filed on Dec. 23, 2009, now Pat. No. 7,963,885.

(60) Provisional application No. 61/140,358, filed on Dec. 23, 2008.

(51) Int. Cl.
*A63B 24/00* (2006.01)

(52) U.S. Cl.
USPC ..... 482/4; 482/1; 482/8; 482/9

(58) Field of Classification Search
USPC ..... 482/1–9, 148, 900–902; 434/247; 446/431
See application file for complete search history.

(56) References Cited

U.S. PATENT DOCUMENTS

| | | | | |
|---|---|---|---|---|
| 1,407,093 | A | 2/1922 | Smith | 446/265 |
| 5,083,968 | A | 1/1992 | Hart | 446/431 |
| 5,306,197 | A | 4/1994 | Watanabe | |
| 6,968,592 | B2 | 11/2005 | Takeuchi et al. | 15/319 |
| 7,625,314 | B2 * | 12/2009 | Ungari et al. | 482/1 |
| 7,658,694 | B2 | 2/2010 | Ungari | 482/1 |
| 7,963,885 | B2 | 6/2011 | Mazzanobile | 482/4 |
| 2006/0106496 | A1 | 5/2006 | Okamoto | 700/253 |
| 2008/0254945 | A1 | 10/2008 | Beyzavi-Armani | 482/8 |
| 2008/0269016 | A1 | 10/2008 | Ungari | |
| 2010/0167875 | A1 | 7/2010 | Mazzanobile | |

OTHER PUBLICATIONS

International Search Report and Written Opinion for PCT/US2012/069564.

* cited by examiner

*Primary Examiner* — Glenn Richman
(74) *Attorney, Agent, or Firm* — C. Rachal Winger; K&L Gates, LLP

(57) ABSTRACT

Disclosed herein are training devices useful for improving the agility and/or speed of a trainee, systems comprising same, and methods of improving a trainee's agility and/or speed. In one embodiment a training device comprises a first sensor operatively associated with a control mechanism, wherein the control mechanism is optionally configured to enable the device to move (a) randomly, (b) in a predetermined movement pattern, or (c) in relation to a second sensor.

47 Claims, 10 Drawing Sheets

SPEED AND/OR AGILITY TRAINING DEVICES AND SYSTEMS AND METHODS FOR USE THEREOF

PRIORITY CLAIM

This application is a continuation-in-part of U.S. patent application Ser. No. 13/163,476, filed Jun. 17, 2011, which is a continuation of U.S. patent application Ser. No. 12/646,899, filed Dec. 23, 2009, now U.S. Pat. No. 7,963,885, which claims priority to U.S. Provisional Patent Application No. 61/140,358, filed Dec. 23, 2008, the complete contents of each of which are incorporated herein by reference.

FIELD OF THE DISCLOSURE

The present disclosure relates generally to training devices, training systems, and methods of their use for improving a trainee's speed and/or agility.

BACKGROUND OF THE ART

Speed and agility are critical in numerous sports and other activities. However, motion in predictable patterns and/or on agility courses can be seen in advance and can be quickly learned by athletes. Existing training systems include stationary courses such as ladder drills, running through tires, or basketball "suicide" drills. Further systems exist, such as targeted chasing systems wherein an athlete moves as rapidly as possible towards a selected one of a set of illuminable lights. However, the selectively illuminable lights are stationary and thus the athlete can quickly adapt and/or anticipate the illumination sequence and/or memorize the locations of the fixed number of illuminable lights. In actual play, however, the motion may be unpredictable, and athletes must be able to still move quickly.

SUMMARY OF THE DISCLOSURE

Disclosed herein are training devices, training systems and methods of their use that provide unpredictable speed and agility training for trainees, such as athletes, aspiring athletes and other individuals including those undergoing physical or recuperative therapies.

Particularly, one embodiment includes a training device comprising: a housing comprising an opening, wherein the housing is operatively associated with at least one moving agency, a shut-off unit removably mated with the opening, a control mechanism operatively associated with the shut-off unit and a drive device the control mechanism enabling the drive device to cause the at least one moving agency to propel the training device when the shut-off unit is mated with the opening and a first sensor operatively associated with the control mechanism.

Another embodiment includes a training device comprising a housing comprising an opening, wherein the housing is operatively associated with at least one moving agency, a shut-off unit removably mated with the opening, a control mechanism operatively associated with the shut-off unit, a first sensor operatively associated with the control mechanism, and a drive device operatively associated with the control mechanism and the at least one moving agency; wherein the control mechanism is configured to enable the drive device to cause the at least one moving agency to propel the training device when the shut-off unit is mated with the opening.

In another embodiment, the control mechanism is configured to enable the drive device to cause the at least one moving agency to propel the training device in a direction associated with a second sensor.

In another embodiment, the control mechanism is configured to enable the drive device to cause the at least one moving agency to stop propelling the training device when a distance between the first sensor and a second sensor falls below a predetermined minimum distance value.

In another embodiment, the control mechanism is configured to enable the drive device to cause the at least one moving agency to propel the training device towards a second sensor when a distance between the first sensor and the second sensor exceeds a predetermined separation value.

In another embodiment, the device further comprises a motion-control device configured to cause the device to move in a random movement pattern.

In another embodiment, the shut-off unit comprises a visual enhancement. In another embodiment, the visual enhancement is a flag, a two-dimensional graphic or a three-dimensional graphic. In another embodiment, the visual enhancement is a three-dimensional graphic that resembles a rabbit.

In another embodiment, the motion-control device configured to cause the training device to move in a movement pattern that mimics a movement pattern of a rabbit.

In another embodiment, the visual enhancement is a flag and wherein the height of the flag is adjustable.

In another embodiment, the device further comprises a memory unit operatively associated with the drive device, wherein the memory unit is configured to store movement data associated with the device.

In another embodiment, the device further comprises a movement selector operatively associated with the drive device.

In another embodiment, the device further comprises a memory unit operatively associated with the drive device and the movement selector, wherein the memory unit is configured to store movement data associated with the device and the movement selector is configured to allow a user to select a movement pattern stored in the memory unit.

In another embodiment, the device is configured to allow a user to select from a plurality of difficulty settings.

In another embodiment, the first sensor is configured to detect a stationary or slow-moving object in its current path and the drive device is configured to cause the at least one moving agency to stop or change direction upon the detection.

In another embodiment, the device is configured such that movement data is capable of being transferred from the memory unit to a computer.

Another embodiment includes a training device comprising: a housing comprising an on/off switch, wherein the housing is operatively associated with at least one moving agency; a first sensor associated with the housing; a drive device operatively associated with the at least one moving agency; and a control mechanism operatively associated with the first sensor and the drive device the control mechanism configured to enable the drive device to cause the at least one moving agency to propel the training device towards or away from a second sensor when the on/off switch is set to an "on" position.

Another embodiment includes a training device comprising a housing comprising an on/off switch, wherein the housing is operatively associated with at least one moving agency; a first sensor associated with the housing; a drive device operatively associated with the at least one moving agency;

and a control mechanism operatively associated with the first sensor, and the drive device, wherein the control mechanism is configured to enable the drive device to cause the at least one moving agency to propel the training device towards or away from a second sensor when the on/off switch is set to an "on" position.

In another embodiment, the control mechanism is configured to stop propelling the device when the distance between the first and second sensors (a) falls below a predetermined separation value, or (b) exceeds a predetermined separation value.

Another embodiment includes a training device comprising: a housing comprising an opening and operatively associated with at least one moving agency; a first sensor associated with the housing; a drive device operatively associated with the at least one moving agency; a control mechanism operatively associated with the first sensor, and the drive device, and a visual enhancement removably associated with the opening and comprising a motion-control device configured to cause the device to change directions in one or more preselected movement patterns and/or propel the device at one or more predetermined speeds and such that when the visual enhancement is removably mated with the opening the control mechanism is configured to enable the drive device to cause the at least one moving agency to propel the training device in a direction away from a second sensor when a distance value between the first and second sensors is below a predetermined separation value.

Another embodiment includes a training device comprising: a housing comprising an opening and operatively associated with at least one moving agency; a first sensor associated with the housing; a drive device operatively associated with the at least one moving agency; a visual enhancement removably associated with the opening and comprising a motion-control device; and a control mechanism operatively associated with the first sensor, and the drive device, wherein, when the visual enhancement is removably mated with the opening: the control mechanism is configured to enable the drive device to cause the at least one moving agency to propel the training device in a direction away from a second sensor when a distance value between the first and second sensors is below a predetermined separation value, and the motion-control device is configured to cause the device to change directions in one or more preselected movement patterns and/or propel the device at one or more predetermined speeds.

DETAILED DESCRIPTION

Disclosed herein are training devices, training systems and methods of using the same. The devices, systems and methods utilize training devices that move in pre-selected or random movement patterns unknown in advance to a trainee that the trainee can chase. Additionally, in system embodiments, the training device can chase the trainee. As used herein, the trainee is the person who uses the device, for example by chasing or being chased by the device for the purpose of improving speed and/or agility. The term "user" as used herein can include the trainee, a coach, a trainer, a therapist, a teammate, or any other third party.

When a device alone is used, discrete training sessions end when the trainee removes a shut-off unit from the device the trainee is chasing and the device stops moving as a result. A next session can begin when the shut-off unit is re-mated with the device. When a system is used, discrete training sessions can end when the trainee removes a shut-off unit from the device and the device stops moving as a result. A next session can begin when the shut-off unit is re-mated with the device. Additionally, when a system is used, discrete training sessions can end when the distance between two sensors (one on the device and one on a trainee) exceeds or falls below a predetermined distance. In these embodiments, a next session can begin based on one or more of when the distance between the two sensors comes back within a predetermined range, based on a signal from the sensor worn by the trainee or based on a predetermined or variable rest interval. Training sessions can also begin and/or end through a user's remote control that can start and stop the device.

Training Devices

Figure 1:
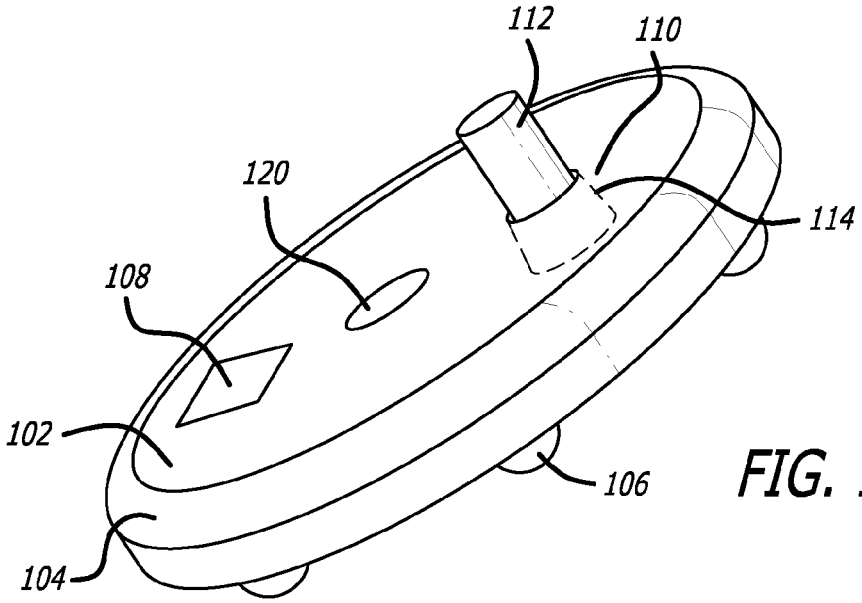
FIG. 1 depicts a perspective view of an exterior of an embodiment of the present device.
Figure 1A:
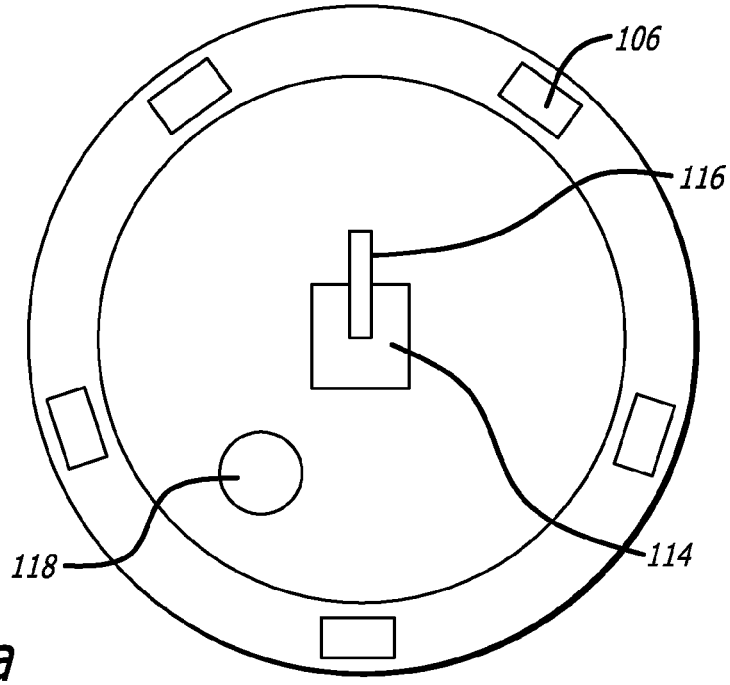
FIG. 1*a* depicts a bottom view of an exterior of an embodiment of the present device.
Figure 1B:
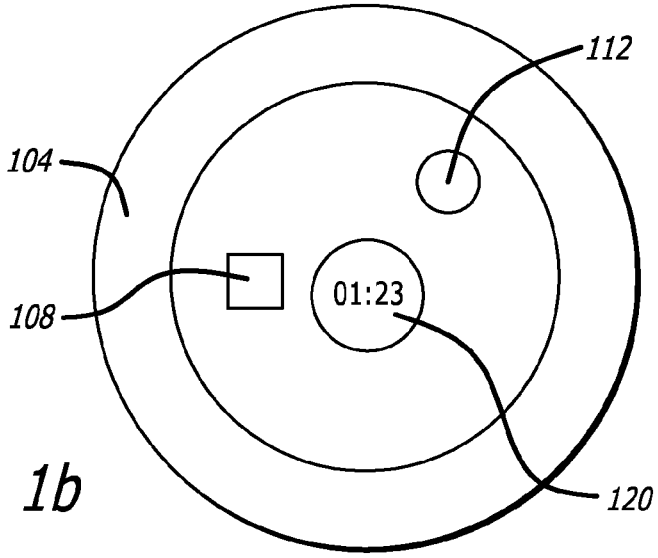
FIG. 1*b* depicts a top view of an interior of an embodiment of the present device.

FIGS. 1-1B depict various views of embodiments of the present device. FIG. 1 depicts a perspective exterior view of one embodiment of the present device. In some embodiments, a housing 102 can comprise a plurality of sections 104, which can be coupled together and substantially vertically arranged. In such embodiments, sections 104 can move independently of each other, or in coordinated movements with each other. However, in other embodiments, a housing 102 can comprise a single hollow member. In still other embodiments, a housing 102 can comprise a skeleton or scaffolding to which the various components described herein are attached. In still other embodiments, a housing 102 can comprise a shell or skin inside of which the various components described herein are encased. As shown in FIG. 1, such a housing 102 can be substantially circular in shape, but in other embodiments can have any other known and/or convenient geometry. In some embodiments, a housing 102 can be made of a resilient plastic, polymer, polycarbonate, metal, alloy, or any other known and/or convenient material. As shown in FIG. 1, a housing 102 can be coupled with a time mechanism 120, such as but not limited to, a timer, stopwatch, clock, and/or any other known and/or convenient mechanism for timing a trainee and/or displaying time.

As shown in FIG. 1*a*, a plurality of moving agencies 106 can be coupled with a housing 102. Moving agencies 106 can be wheels, casters, bearings, or any other known and/or convenient device. In some embodiments, moving agencies 106 can have a rotational range of motion of 360 degrees, or any other known and/or convenient range. As shown in FIG. 1*a*, moving agencies 106 can be coupled with a housing 102 at points on the underside of and, in some embodiments, substantially proximal to the periphery of a housing 102. However, in other embodiments, moving agencies 106 can be coupled with a housing 102 in any known and/or convenient locations.

In some embodiments, one of the moving agencies 106 can be configured to drive a housing 102 in any desired direction. In some embodiments, the moving agencies 106 can be configured to randomly drive a housing 102 in any direction. In alternate embodiments, more than one of the moving agencies 106 can be configured to drive the housing 102 either separately and/or simultaneously.

In some embodiments, a switch 108 can be located on the top surface of a housing 102, but in other embodiments can be located on a side or underside surface. An on-off switch 108 can be adapted to selectively control the operation of the moving agencies 106, drive device 114, and/or power the device on and off.

In the embodiment depicted in FIG. 1, a housing 102 can include an opening 110 adapted to receive a shut-off unit 112. In some embodiments, an opening 110 can be substantially circular, but in other embodiments can have any other known and/or convenient geometry. In the embodiment depicted in FIG. 1, a shut-off unit 112 can be selectively and operatively mated with an opening 110 such that a device will not be propelled when a shut-off unit 112 is not mated with an opening 110. A shut-off unit 112 can have a substantially cylindrical shape, as shown in FIG. 1, but in other embodiments can have any other known and/or convenient geometry. In some embodiments a shut-off unit 112 can be magnetized in a desired configuration and an opening 110 can include a magnetic reader such that the pattern and/or random sequence can be defined by the magnetic configuration of a shut-off unit 112 and/or the speed of insertion of a shut-off unit 112 into an opening 110.

As shown in FIG. 1*a*, a drive device 114 can be coupled to a first moving agency 116 and coupled to a power supply 118. In some embodiments, a power supply 118 can be a battery, but in other embodiments can be a solar cell or any other known and/or convenient device. In some embodiments, a drive device 114 can be a motor, but in other embodiments can be any other known and/or convenient mechanism. In the embodiment shown in FIG. 1*a*, a drive device 116 can be connected to at least one moving agency such as a wheel, but in other embodiments, without limitation, a caster, bearing, or any other known and/or convenient device.

In alternate embodiments, a drive device 114 can further comprise a pump and/or turbine system. In such embodiments, a drive device 116 can be a nozzle, propeller, or any other known and/or convenient device to produce thrust. In such embodiments, moving agencies 106 can be fins or any other known and/or convenient device.

Figure 2:
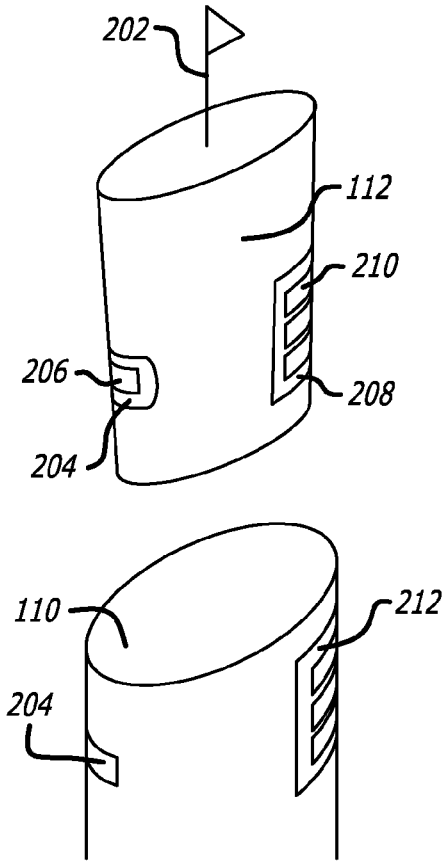
FIG. 2 depicts a detail perspective view of an embodiment of a shut-off unit of the present device.

FIG. 2 depicts a detail view of one embodiment of a shut-off unit 112. As shown in FIG. 2, a shut-off unit 112 can further comprise a visual enhancement 202 that can be a flag, two-dimensional or three-dimensional graphic, or any other known and/or convenient device. A shut-off unit 112 can further comprise a control mechanism 204 that can control stop-and-go motion of the device. In some embodiments, a control mechanism 204 can comprise an electrical coupling 206 that when disrupted causes the device to cease motion. In some embodiments, an electrical coupling 206 can further comprise magnetic components. However, in other embodiments, any other known and/or convenient control mechanism can be used.

In some embodiments, as shown in FIG. 2, a shut-off unit 112 can further comprise a motion-control device 208, which can further comprise at least one magnet 210. In some embodiments, a motion-control device 208 can be a magnetostatic device with the at least one magnet 210 capable of producing an electrical current that can be used to create a seed value for input into a random-pattern generator. A reader 212 can be located in an opening 110 such that a pattern and/or random sequence can be defined by a magnetic configuration of at least one magnet 210 on a shut-off unit 112 and/or the speed of insertion of a shut-off unit into an opening 110.

In particular embodiments, the device is configured to move in a predetermined pattern. The predetermined pattern can include, without limitation, a line, a zig-zag, an arc, a curve, a sinusoidal curve, a circle, a semi-circle, an oval, a random path, and combinations thereof. In particular embodiments, the predetermined pattern is selected by a user before initiating the training session. The predetermined pattern can also be randomly selected by the device and in certain embodiments, can change during the training session.

In particular embodiments, the device comprises a movement pattern selector. The movement pattern selector can be, without limitation, a switch, a button, a toggle, a dial or a touchpad. In particular embodiments, the movement pattern selector can be associated with a remote-control unit 302. As is understood by one of ordinary skill in the art, the movement pattern selector is appropriately coupled to the drive device and CPU.

In particular embodiments, the shut-off unit 112 comprises a motion-control device 208 which is configured to select a predetermined movement pattern from a plurality of movement patterns stored on the CPU 406. In particular embodiments, the predetermined movement pattern is automatically selected when the shut-off unit 112 is mated with the opening 110. For example, a shut-off unit associated with a visual enhancement can be configured to automatically select a movement pattern associated with the visual enhancement. In other embodiments, a user is prompted to select a movement pattern from a list of predetermined movement patterns upon mating a shut-off unit 112 with the opening 110.

As stated, in some embodiments, the device comprises a visual enhancement associated with the shut-off unit. In particular embodiments, the visual enhancement is selected from a flag, a two-dimensional graphic, or a three-dimensional graphic. In particular embodiments, the visual enhancement is a two- or three-dimensional graphic that resembles an animal, such as a dog, a horse, a rabbit, a cheetah, an antelope, a wildebeest, a lion, a gazelle, an elk, a coyote, a fox, a hyena, a zebra, a greyhound, a whippet, a deer, or the like.

In particular embodiments wherein the visual enhancement is a two- or three-dimensional graphic that resembles an animal, the device may optionally comprise a motion-control device configured to cause the training device to move in a pattern that mimics a movement pattern of that animal. As an example, when the visual enhancement resembles a rabbit, a motion-control device may be configured to cause the device to: (a) move up to a speed achievable by a rabbit (e.g., up to 45 miles per hour), (b) change speeds at a frequency typical of a rabbit (e.g., abruptly starting and stopping and speeding up or slowing down with changes occurring every 1 second, every 2 seconds, every 3 seconds, every 4 seconds, every 5 seconds, every 6 seconds, every 7 seconds, every 8 seconds, every 9 seconds, every 10 seconds, every 11 seconds, every 12 seconds, every 13 seconds, every 14 seconds, every 15 seconds, every 16 seconds, every 17 seconds, every 18 seconds, every 19 seconds, every 20 seconds, every 21 seconds, every 22 seconds, every 23 seconds, every 24 seconds, every 25 seconds, every 26 seconds, every 27 seconds, every 28 seconds, every 29 seconds, every 30 seconds and combinations of the foregoing intervals), (c) change directions at a frequency typical of a rabbit (e.g., one directional change every 1 second, every 2 seconds, every 3 seconds, every 4 seconds, every 5 seconds, every 6 seconds, every 7 seconds, every 8 seconds, every 9 seconds, every 10 seconds, every 11 seconds, every 12 seconds, every 13 seconds, every 14 seconds, every 15 seconds, every 16 seconds, every 17 seconds, every 18 seconds, every 19 seconds, every 20 seconds, every 21 seconds, every 22 seconds, every 23 seconds, every 24 seconds, every 25 seconds, every 26 seconds, every 27 seconds, every 28 seconds, every 29 seconds, every 30 seconds and combinations of the foregoing intervals), and/or (d) change directions at an angle typically associated with a rabbit (e.g., 1° to 359° and every degree in between from a current direction of travel in either direction at an interval of every 1 second, every 2 seconds, every 3 seconds, every 4 seconds, every 5 seconds, every 6 seconds, every 7 seconds, every 8 seconds, every 9 seconds, every 10 seconds, every 11 seconds, every 12 seconds, every 13 seconds, every 14 seconds, every 15 seconds, every 16 seconds, every 17 seconds, every 18 seconds, every 19 seconds, every 20 seconds, every 21 seconds, every 22 seconds, every 23 seconds, every 24 seconds, every 25 seconds, every 26 seconds, every 27 seconds, every 28 seconds, every 29 seconds, every 30 seconds and combinations of the foregoing intervals). Each of these parameters can be combined in numerous combinations randomly or according to chosen selection logic parameters to generate a large number of rabbit-like movement patterns.

As a second example, when the visual enhancement resembles a greyhound, a motion-control device could be expected to move in a less erratic manner than a rabbit program. For example, a greyhound program could cause the device to: (a) move up to a speed achievable by that of a greyhound (e.g., up to 25 miles per hour), (b) change speeds at a frequency typical of a greyhound (e.g., abruptly starting and stopping and speeding up or slowing down with changes occurring every 10 seconds, every 11 seconds, every 12 seconds, every 13 seconds, every 14 seconds, every 15 seconds, every 16 seconds, every 17 seconds, every 18 seconds, every 19 seconds, every 20 seconds, every 21 seconds, every 22 seconds, every 23 seconds, every 24 seconds, every 25 seconds, every 26 seconds, every 27 seconds, every 28 seconds, every 29 seconds, every 30 seconds, every 31 seconds, every 32 seconds, every 33 seconds, every 34 seconds, every 35 seconds, every 36 seconds, every 37 seconds, every 38 seconds, every 39 seconds, every 40 seconds, every 41 seconds, every 42 seconds, every 43 seconds, every 44 seconds, every 45 seconds, every 46 seconds, every 47 seconds, every 48 seconds, every 49 seconds, every 50 seconds, every 51 seconds, every 52 seconds, every 53 seconds, every 54 seconds, every 55 seconds, every 56 seconds, every 57 seconds, every 58 seconds, every 59 seconds, every 60 seconds and combinations of the foregoing intervals), (c) change directions at a frequency typical of a greyhound (e.g., one directional change every 10 seconds, every 11 seconds, every 12 seconds, every 13 seconds, every 14 seconds, every 15 seconds, every 16 seconds, every 17 seconds, every 18 seconds, every 19 seconds, every 20 seconds, every 21 seconds, every 22 seconds, every 23 seconds, every 24 seconds, every 25 seconds, every 26 seconds, every 27 seconds, every 28 seconds, every 29 seconds, every 30 seconds, every 31 seconds, every 32 seconds, every 33 seconds, every 34 seconds, every 35 seconds, every 36 seconds, every 37 seconds, every 38 seconds, every 39 seconds, every 40 seconds, every 41 seconds, every 42 seconds, every 43 seconds, every 44 seconds, every 45 seconds, every 46 seconds, every 47 seconds, every 48 seconds, every 49 seconds, every 50 seconds, every 51 seconds, every 52 seconds, every 53 seconds, every 54 seconds, every 55 seconds, every 56 seconds, every 57 seconds, every 58 seconds, every 59 seconds, every 60 seconds and combinations of the foregoing intervals), and/or (d) change directions at an angle typically associated with a greyhound (e.g., 1° to 45° and every degree in between from a current direction of travel in either direction at an interval of every 20 seconds, every 21 seconds, every 22 seconds, every 23 seconds, every 24 seconds, every 25 seconds, every 26 seconds, every 27 seconds, every 28 seconds, every 29 seconds, every 30 seconds, every 31 seconds, every 32 seconds, every 33 seconds, every 34 seconds, every 35 seconds, every 36 seconds, every 37 seconds, every 38 seconds, every 39 seconds, every 40 seconds, every 41 seconds, every 42 seconds, every 43 seconds, every 44 seconds, every 45 seconds, every 46 seconds, every 47 seconds, every 48 seconds, every 49 seconds, every 50 seconds, every 51 seconds, every 52 seconds, every 53 seconds, every 54 seconds, every 55 seconds, every 56 seconds, every 57 seconds, every 58 seconds, every 59 seconds, every 60 seconds and combinations of the foregoing intervals). Each of these parameters can be combined in numerous combinations randomly or according to chosen selection logic parameters to generate a large number of greyhound-like movement patterns.

In particular embodiments, the visual enhancement can be adjustable. For example, the visual enhancement can be adjustable to suit particular use characteristics such as the height of the trainee or the physical environment such as the presence of grasses or other visual obstructions or winds. In more particular embodiments, one or more of the height, position, angle, tilt, and/or rotational position (relative to the housing) of the visual enhancement can be adjustable. As an example, when the visual enhancement is a flag, the height of the flag may be adjustable by constructing the flag of a telescoping material, such a series of coaxial tubes. As is understood by one of ordinary skill in the art, various other hinges, sliders, locking devices, etc. can be used to create adjustable visual enhancements.

Figure 3B:
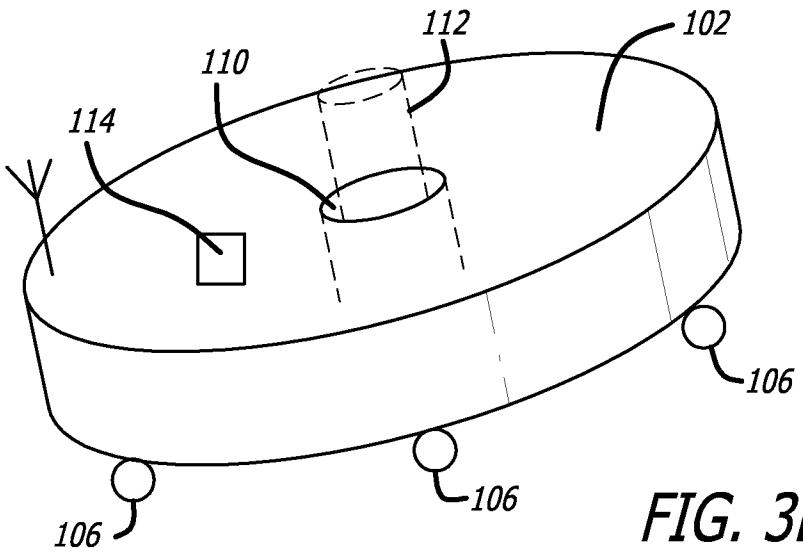
FIG. 3 depicts another embodiment of the present device further comprising a remote-control unit.
Figure 3A:
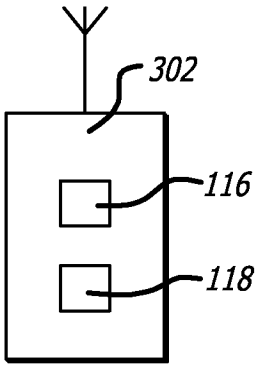

FIG. 3 depicts another embodiment of the present device, further comprising a remote-control unit 302. A remote-control unit 302 can operate via a wireless connection or any other known and/or convenient mechanism. As depicted in FIG. 3, the remote control 302 can have one or more various controls 116, 118 for controlling features such as stop, go, speed, direction, on/off status, or any other known and/or desired parameters, etc.

Figure 4:
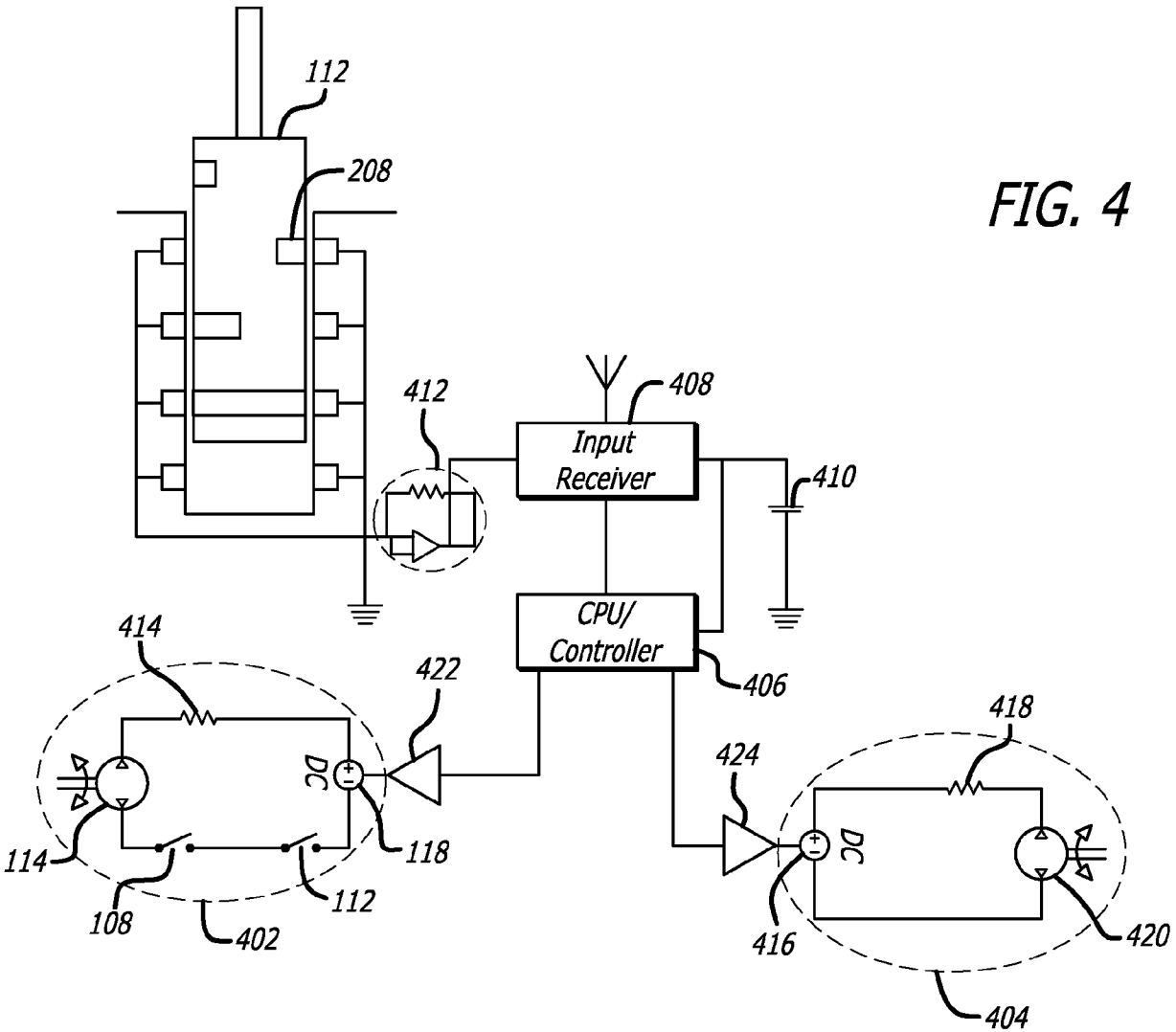
FIG. 4 depicts a schematic diagram of one embodiment of the present device.

FIG. 4 depicts an electro-mechanical schematic of one embodiment of the present device. A drive-control circuit 402 and a directional-control circuit 404 can both be connected to a central processing unit (CPU) 406. A CPU 406 can be connected to an input device/receiver 408, which can be connected to a power supply 410. A motion-control device 208 can be connected to an input device/receiver 408 via an op-amp circuit 412. A remote-control 302 can also provide input to an input device/receiver 408 via a wireless connection or any other known and/or convenient method. In some embodiments, a CPU 406 can also be capable of collecting motion information from the device and connecting to an external personal computer to download such information. Further, in some alternate embodiments, a device can include a timing mechanism 120 (as shown in FIG. 1) to record and optionally display chronological information regarding motion of the device.

In a drive-control circuit 402, a power supply 118 can be connected to a shut-off unit 112, an on-off switch 108, a drive device 114, and a resistor 414. In some embodiments, a drive device 114 can be a motor, but in other embodiments can be any other known and/or convenient device. As shown in FIG. 2, a power supply 118 can be a variable power supply, or in other embodiments can be any other known and/or convenient device.

In a directional-control circuit 404, a power supply 416 can be connected to a resistor 418 and a drive device 420. In some embodiments, a drive device 420 can be a motor, but in other embodiments can be any other known and/or convenient device.

A CPU 406 can be connected to a power supply 118 for a drive circuit 402 via an amplifier 422, and also to a power supply 416 for a directional-control circuit 404 via an amplifier 242. In such embodiments, a CPU can, therefore, provide input to control a drive circuit 402 and a directional-control circuit 404.

As shown in FIG. 4, a motion-control device 208 can, in some embodiments, be incorporated into a shut-off unit 112. A magnet 210 on a shut-off unit 112 can, when in motion, produce a current that can be read by a reader 212. An induced current can vary depending upon the orientation of magnets 210 in relation to readers 212 and the speed of magnets 210 in moving past readers 212. In embodiments having multiple magnets 210 and readers 212, as shown in FIG. 4, the electrical signals resulting from an induced current can be summed in an op-amp circuit 412 and sent to a CPU 406 via an input device/receiver 408. A CPU 406 can process these electrical signals to provide control information to a drive-control circuit 402 and a directional-control circuit 404 by using electrical signals to establish a seed value for a random-number generator in a CPU 406. In some embodiments, a random number generator can translate an electrical signal into numerical values. In such embodiments, a numerical value can be parsed into separate values, each of which can be used to control speed and direction. For example, in some embodiments, a numerical value can have a plurality of digits. One or more digits can correspond to a seed value for speed control, one or more other digits can correspond to a seed value for the control time period, and at least one remaining digit can correspond to a seed value for directional control.

In particular embodiments, the CPU 406 is configured to automatically select control information when a shut-off unit 112 comprising a motion-control device 208 is mated with an opening 110. In particular embodiments, the control information causes the drive-control unit 402 and directional-control unit 404 to cause the device to move about in a manner that mimics movement associated with the natural or typical movement style of the object represented by a visual enhancement associated with the shut-off unit 112 as described above. Particularly, in one example, a shut-off device with a visual enhancement in the general shape of an animal may comprise a motion-control device 208 configured to cause a CPU 406 to provide control information to a drive-control unit 402 and a directional-control unit 404 in a manner that causes the device to move in a manner reminiscent of the animal.

Figure 5:
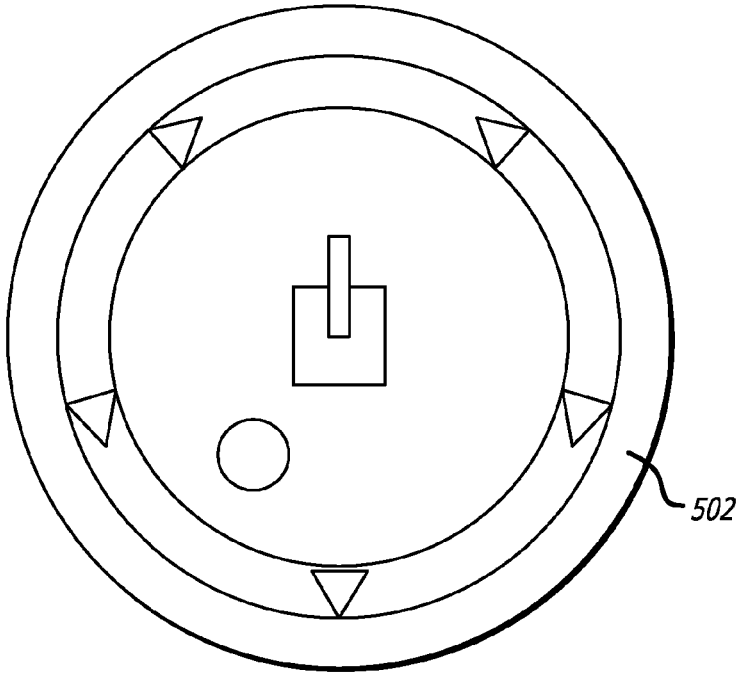
FIG. 5 depicts a bottom view of another embodiment of the present device that can operate in an aquatic environment.

FIG. 5 depicts another embodiment of the present device that can operate in an aquatic environment. Such embodiments can further comprise a flotation device 502, which can be located circumferentially around a housing 102, or in any other known and/or convenient position. In some embodiments, a housing 102 can be comprised of a buoyant material.

Figure 6:
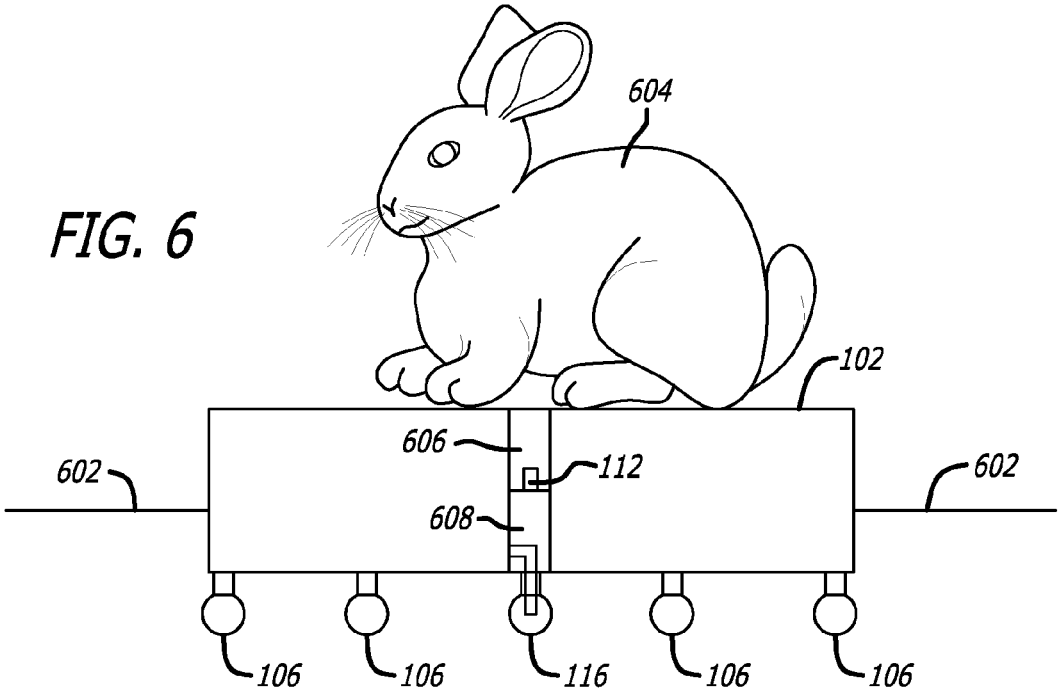
FIG. 6 depicts a side view of an alternative embodiment of the present device.

FIG. 6 depicts a side view of another embodiment of the present device. In some embodiments, a housing 102 can include extension arms 602 adapted to reduce the likelihood of overturning the device. Moreover, in some embodiments the shut-off unit 112 can be coupled with a visual enhancement 604. In some embodiments, the visual enhancement 604 can have the shape of a rabbit and/or any desired shape. In some embodiments, a shut-off unit 112 can include a depression 216 that can mate with a protrusion at the base of the opening 110. In some embodiments, the protrusion can be coupled with a rotational motor 608 such that as the motor rotates, both the drive device 116 and the visual enhancement 604 can rotate in unison. In alternate embodiments, the visual enhancement 604 and drive device 116 can move and/or rotate independently.

In use, a user can turn a switch 108 to the "on" position and insert a shut-off unit 112 into an opening 110. In certain embodiments the shut-off unit can also function as an on/off switch for the device. As stated, the present device can then begin to move about and be chased by a trainee, who could have the goal of overtaking the device and removing the shut-off unit 112, to cause the device to stop moving. A trainee can also chase the device without the goal of removing a shut-off unit 112, but rather to follow a prescribed pattern. In some embodiments, motion of the device can be determined by a magnetostatic device that produces a random movement pattern. In other embodiments, motion can be controlled by a remote user via a remote-control unit 302. Either way, the unknown and/or erratic movement of the present device can require the trainee chasing the device to change speed and direction quickly, therefore, developing speed and agility.

In particular embodiments, a CPU 406 is configured to store movement data associated with the device. In particular embodiments, the CPU 406 automatically stores movement data. In additional embodiments, the device is configured to prompt a user to select a prior movement pattern stored in a memory unit associated with the CPU 406. In particular embodiments, the remote-control unit 302 comprises a memory selector configured to cause the device to repeat a prior movement pattern stored in a memory unit associated with the CPU 406. In more particular embodiments, the CPU 406 is configured to store movement data from operation of the device when controlled by the remote-control unit 302.

In certain embodiments, a user can select from a plurality of difficulty settings. Higher difficulty settings can be associated with one or more of increasing speed of the device, increased frequency of changes in speed and/or direction, increased magnitude of directional changes and/or combinations of the foregoing. In another embodiment, the device is configured to prompt a user to select an initial difficulty setting, wherein to "unlock" a subsequent, more challenging difficulty setting, a trainee must complete the initial difficulty setting. In particular embodiments, the CPU 406 is configured to require a trainee to complete a first level of difficulty before selecting a second, more advanced level of difficulty. Moreover, different settings can be chosen for different training purposes. For example, some settings may be geared towards enhancing speed over agility and these settings could have the device travel in straighter paths for longer periods of time at higher speeds than other settings geared more towards agility.

Figure 7:
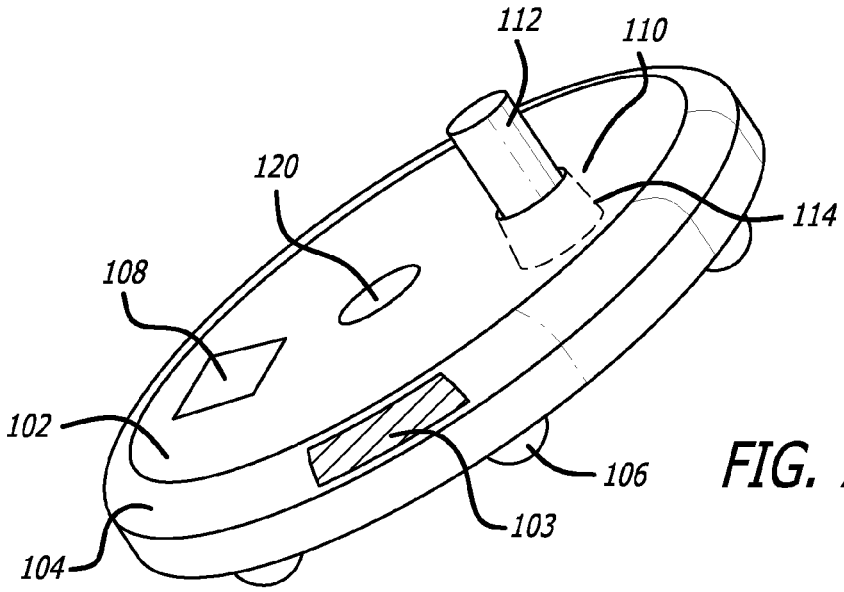
FIG. 7 depicts a perspective view of an exterior of an embodiment of the present device.
Figure 8:
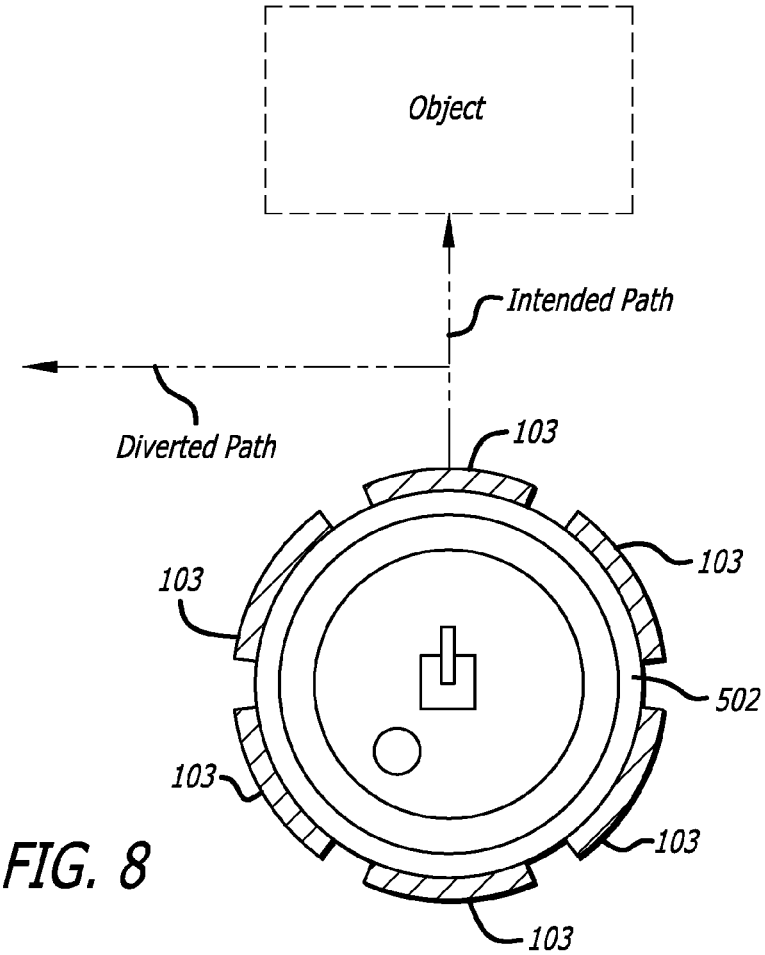
FIG. 8 depicts a top view of an embodiment of the present device, wherein the device is configured to change directions to avoid colliding with an object.
Figure 9:
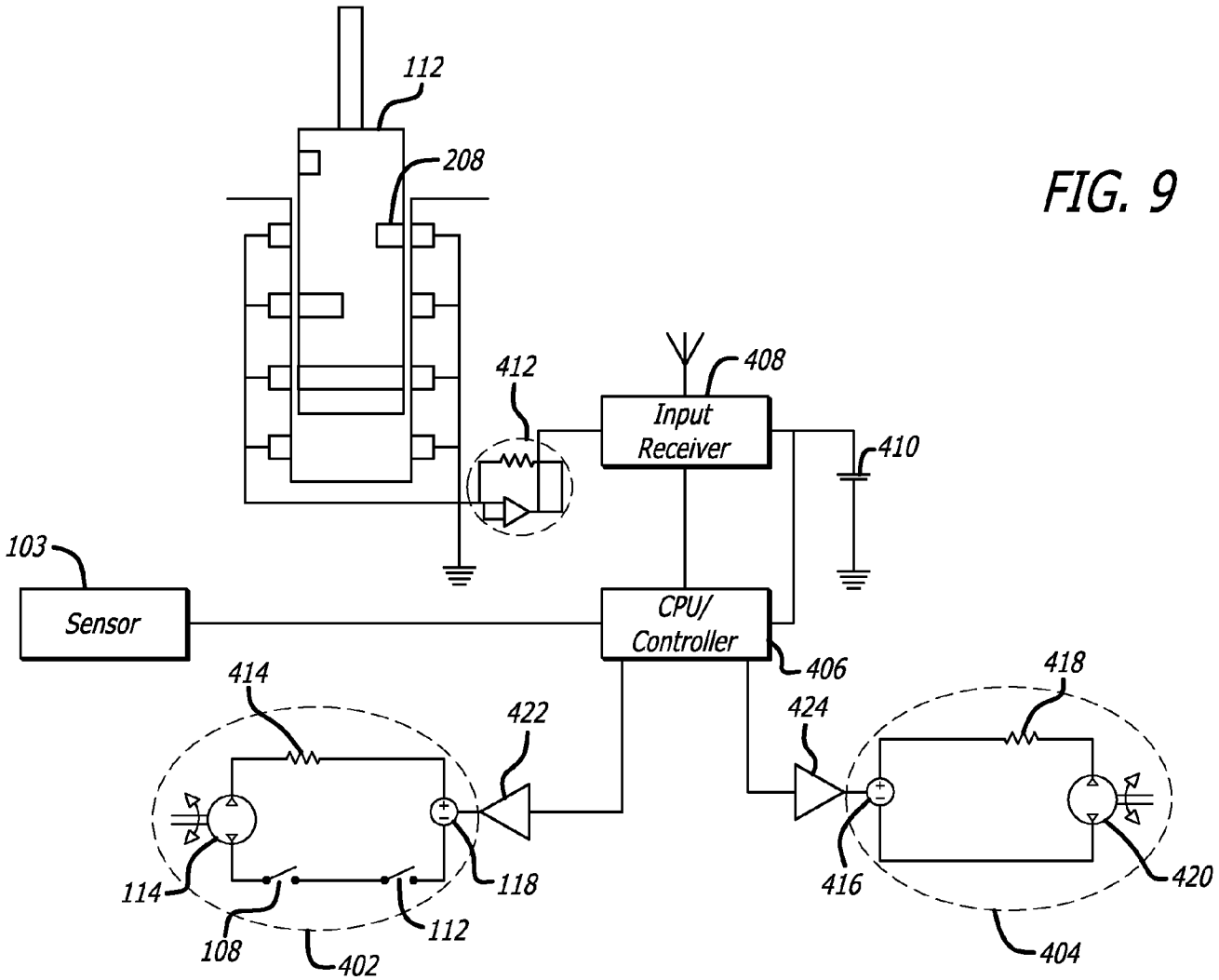
FIG. 9 depicts a schematic diagram of one embodiment of the present device with a sensor.

As shown in FIGS. 7 and 8, embodiments of the device can further comprise at least one sensor 103 configured to detect an object, such as a stationary or slow-moving object (e.g., a wall, furniture, a curb, a vehicle, a person, and the like) within the device's path. For example, CPU 406 can be configured to cause the device to stop, change direction and/or speed when a sensor associated with the CPU 406 senses a stationary or slow-moving object in its path. In particular embodiments, the device is configured such that, when the at least one sensor detects an object, the drive device causes the device to change speed and/or direction in a manner to avoid colliding with the object. In another embodiment, the at least one drive device is configured to cause the at least one moving agency to propel the device in a manner to avoid colliding with the object detected by the first sensor. Any type of detector known in the art may be used, such as a mechanical sensor (e.g., whisker-like fiber), an electronic sensor (e.g., ultrasonic, microwave, infrared, laser, videographic, tomographic), or combinations thereof and as is understood by one of ordinary skill in the art, sensors can be positioned at various locations on the device to facilitate sensing in 360 degrees and/or 3 dimensions. In particular embodiments such as that shown in FIG. 8, the device is configured to stop, change speed and/or direction to avoid an object detected by the at least one sensor. As used herein, a "slow-moving object" is one that would not escape the device's intended path, but for the device's stopping or changing direction.

Interactive Training Systems

Embodiments disclosed herein also include interactive training systems. In these embodiments, any of the devices described above comprise at least one sensor configured to communicate with at least one complementary sensor worn by a trainee. In particular embodiments, the device is configured to determine the distance and/or directional relationship between the device and the at least one sensor worn by the trainee. In some embodiments the trainee can wear the at least one sensor, for example but without limitation, on the trainee's ankle or both ankles, wrist or both wrists, a bib, a vest, and so on, and/or any combination or multiple of the above. In particular embodiments the sensor can comprise a mask, cuff, or some other article worn by the trainee such that trainee diagnostics can be monitored during, before and/or after training. Also, as above for detecting a slow-moving object, these at least one sensors can also be positioned at various locations on the device to facilitate sensing the complementary sensor in 360 degrees and/or 3 dimensions.

In particular embodiments, the sensor and a complementary sensor worn by a trainee comprise a wireless sensor network (WSN). In one embodiment, a distance between the device and one or more trainees is determined by a received signal strength (RSS) protocol (e.g., based on the attenuation between a transmitted signal and the corresponding received signal). In another embodiment, a distance between the device and one or more trainees is determined by a time of arrival (TOA) or a time difference of arrival (TDOA) protocol (e.g., by calculating a time of flight of a packet transmitted from the device and received by a complementary sensor or vice versa). In another embodiment, a distance and/or directional relationship between the device and one or more trainees is determined by the use of a global positioning satellite (GPS) system.

In particular embodiments, the control mechanism is configured to enable the drive device to cause the at least one moving agency to propel the training device in a direction associated with the trainee's sensor. These interactive training systems allow the device and trainee to interact, that is the behavior of each can change based on the activity of the other. This device/trainee interaction can improve the benefit obtained by the trainee over multiple practice sessions.

Figure 10B:
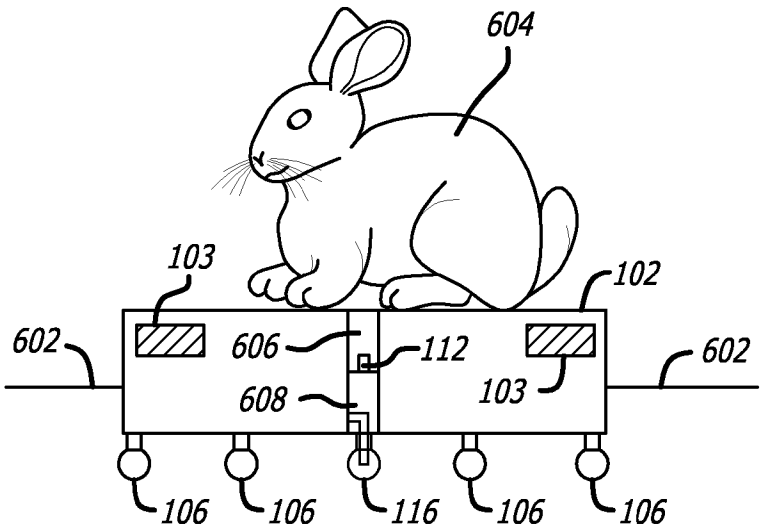
FIG. 10 depicts a side view of an embodiment of the present system, wherein the device is configured to move in the direction of a second sensor.
Figure 10A:
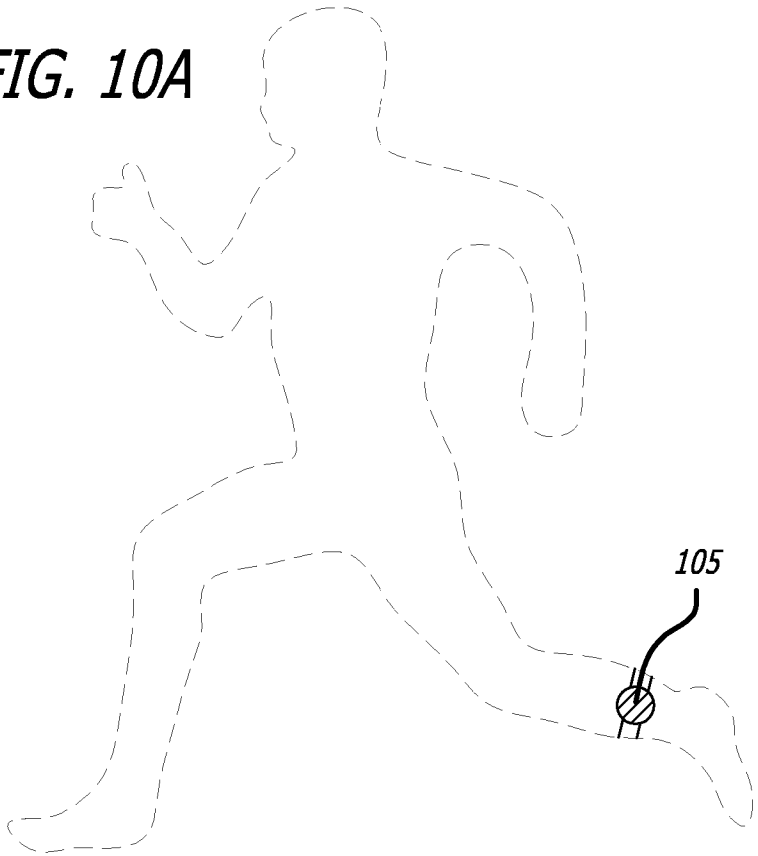

In one systems embodiment, the device is configured to chase, i.e., move in the direction of the trainee, based at least in part on sensing the directional relationship and/or distance between the device and the trainee. In this embodiment, the device can be configured to stop chasing the trainee (by significantly slowing or stopping movement) when the distance between the trainee and the device falls below a predetermined separation value (FIG. 10). Alternatively, when the distance between the device and trainee falls below a predetermined separation value, the device can change from chase to run mode and the trainee can then chase the device.

Figure 11B:
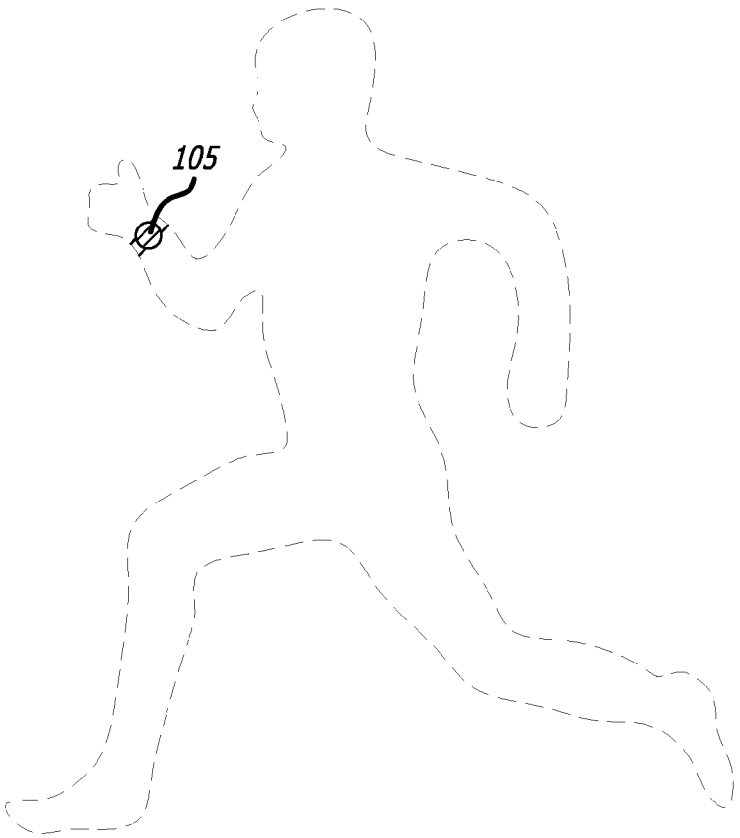
FIG. 11 depicts a side view of an embodiment of the present system, wherein the device is configured to move in a direction away from a second sensor.
Figure 11A:
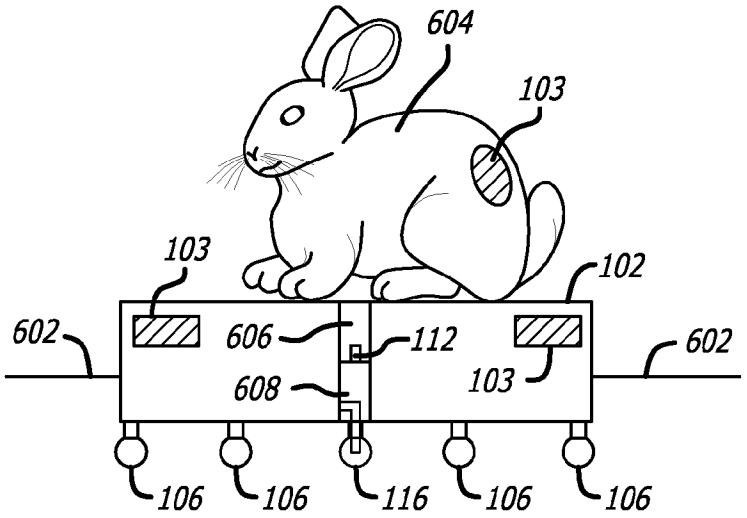

In additional embodiments, the trainee can chase the device first (FIG. 11), and when the distance between the device and the trainee falls below a predetermined separation value, the device can signal that the trainee "won" by significantly slowing or stopping movement. Alternatively, when the distance between the device and trainee falls below a predetermined separation value, the device can change from run to chase mode and the trainee can then run from the device.

In particular embodiments, the at least one complementary sensor worn by a trainee is configured to measure and/or monitor one or more of various diagnostics of the trainee, including without limitation heart rate, oxygen consumption, carbon dioxide emission, chemicals exhaled, calories consumed, fat burned, various parameters of metabolism such as lactic acid levels, skin conductivity, blood pressure, hydration level, lung capacity, and so forth. In some embodiments, the device can significantly slow or stop movement when one or more of a diagnostic of the trainee attains, surpasses, or falls below a particular level, threshold, and/or rate, and/or after one or more diagnostics has been maintained at a particular level over a period of time, and so forth.

Figure 12C:
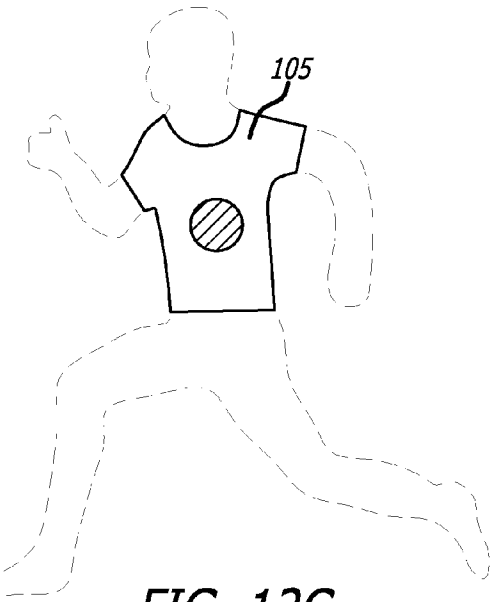
FIG. 12 depicts a side view of an embodiment of the present system, wherein the device is configured to move in a direction (towards or away from) a plurality of sensors.
Figure 12B:
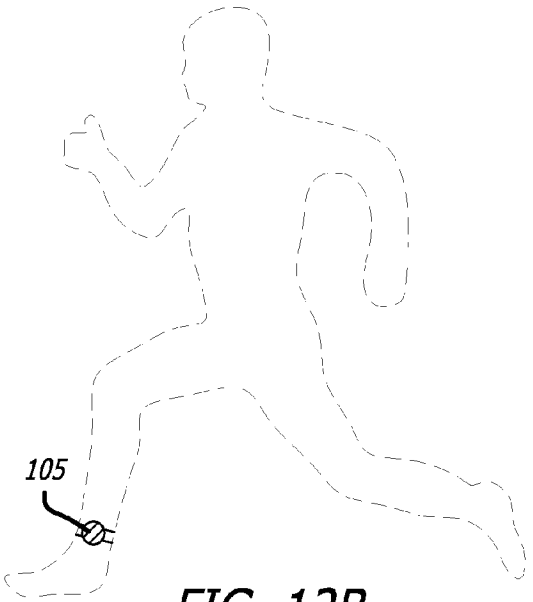
Figure 12A:
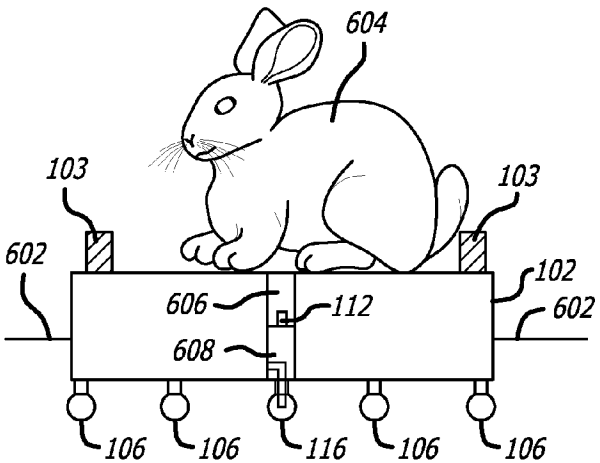

In another systems embodiment, a plurality of trainees can simultaneously chase the device (FIG. 12), and when the distance between the device and any one of the plurality of trainees falls below a predetermined value, the device can signal that a trainee "won" by significantly slowing or stopping movement. In a related embodiment, the device is configured to determine the distance between the device and each of the plurality of trainees. In a related embodiment, the device is configured to differentiate between each of the plurality of trainees such that, when the distance between the device and one of the plurality of trainees falls below a predetermined value, the device can signal which of the plurality of trainees "won" by, for example, indicating on a display an identifier associated with the winning trainee (e.g., a colored light), audibly announcing the winning trainee's name (e.g., which has been pre-assigned to the trainee before initiating the training session), and the like. In particular embodiments, the device is configured to track multiple trainees using a single sensor (e.g., via the use of multiple complementary sensors each associated with a unique identifier). In a related embodiment, the device is configured to store data about each of the plurality of trainees' movements and/or number of "wins."

In particular embodiments, the predetermined minimum distance value is selected by a user before initiating the chase. In particular embodiments, the predetermined minimum distance value is selected by a user from a list of minimum distance values. In particular embodiments, the predetermined minimum distance value is programmed or entered into the device by a user. In particular embodiments, the predetermined minimum distance value is selected by the device. In particular embodiments, the predetermined minimum distance value is programmed into the CPU. In particular embodiments, a predetermined separation value is 1 foot to 20 feet, for example 1 foot, 2 feet, 3 feet, 4 feet, 5 feet, 6 feet, 7 feet, 8 feet, 9 feet, 10 feet, 11 feet, 12 feet, 13 feet, 14 feet, 15 feet, 16 feet, 17 feet, 18 feet, 19 feet, or 20 feet. This distance can also be extended to, for example, a distance such as 50 feet or 100 feet or more depending on the physical space available and the skill and speed level of the trainee. In another embodiment, the predetermined separation value is selected by a user from a list of separation values stored in a memory unit operatively associated with the device.

In particular embodiments, a rest interval occurs between mode changes. In other embodiments, there is no rest interval. When a rest interval is employed it can be a set or variable amount of time (for example, 5 seconds to 5 minutes) or can be based on a characteristic of the trainee, such as heart rate. In this embodiment, a heart rate sensor can be linked to the trainee's sensor such that the trainee's sensor signals a rest stop to the device until a predetermined heart rate is achieved.

In particular embodiments, a CPU is configured to store movement and other data associated with the trainee such as the trainee's speed, direction, type of course, time to capture or be captured by the device generally and within particular settings, diagnostics related to the trainee, etc. In particular embodiments, the device further comprises a CPU associated with the memory unit that is capable of connecting to an external computer or other device to download such information. In some embodiments the external computer or other device is one or more of a mobile device, a laptop computer, a desktop or personal computer (PC), a mobile digital device such as an iPod® (Apple, Cupertino, Calif.), etc. The data can be used to provide feedback to a user to further improve the trainee's speed, agility, and/or reaction time. The data can also be used for additional purposes such as, without limitation, research or marketing purposes. In some embodiments the external computer or other device comprises or is connected to a monitor or other viewing devise such that the downloaded information can be viewed. In particular embodiments the downloaded information is viewable on the remote control (see, e.g., FIG. 3).

Methods of Use

With the devices and systems described herein, one or more than one trainee can participate within a training session. For example, one trainee can use the device alone acting as trainee and user with no other individuals present. Alternatively, a number of trainees can use the device serially, each having an individual training session. A number of trainees can also simultaneously chase the device with the trainee removing the shut-off unit being declared the winner. Winning a training session could be associated with various incentives or prizes. Additionally, trainees could be grouped in pairs or teams to compete against other pairs or teams. In addition to improving the speed and/or agility of the individual trainees, such pair or teamwork could also serve to improve communication and coordination between members of a pair or team.

With the systems described herein, more than one trainee can also participate within a training session. The number of trainees is limited solely by, capabilities of the device sensors to communicate, track and respond to more than one trainee sensor. As is understood by one of ordinary skill in the art, simultaneous interaction is available based on use of different channels, signals and/or frequencies.

In particular embodiments, a method includes enabling a trainee to improve speed and/or by exposing the trainee to a training system comprising a training device which comprises a housing comprising an on/off switch and a control mechanism, wherein the control mechanism is operatively associated with at least one moving agency, a drive device operatively associated with the control mechanism and the at least one moving agency.

In additional embodiments, the methods include enabling a trainee to improve speed and/or by exposing the trainee to a training system comprising (a) a training device which comprises a housing comprising an on/off switch and a control mechanism, wherein the control mechanism is operatively associated with at least one moving agency, a drive device operatively associated with the control mechanism and the at least one moving agency and a first sensor operatively associated with the control mechanism; and (b) a second sensor not associated with the housing, wherein the control mechanism is configured to enable the drive device to cause the at least one moving agency to propel the training device when the on/off switch is in an "on" position, and wherein the first sensor is configured to communicate with the second sensor.

In particular embodiments, methods disclosed herein include improving the speed and/or agility of a trainee, by (a) providing a training system as disclosed herein; (b) turning the on-off switch of the training device to an "on" position; (c) prompting the trainee to chase the training device; and (d) repeating steps (b) and (c) a plurality of times.

In additional embodiments disclosed herein, methods include improving the speed and/or agility of a trainee by transferring movement data associated with the trainee and/or device to a computer. The movement data can then be analyzed to monitor the trainee's form, agility, speed, responsiveness, time to complete a difficulty level, and the like. Over time, the movement data is useful in monitoring a trainee's improvement in agility and/or speed through repeated iterations of the training methods disclosed herein.

In some embodiments disclosed herein, a training session can start or stop based on one or more of the trainee's data monitored by the device, as described above, or based on a measurement of time such as time until the next competition, time passed since the last competition, etc.

Methods disclosed herein also comprise providing a training device comprising: a housing comprising an opening, wherein the housing is operatively associated with at least one moving agency, a shut-off unit removably mated with the opening, a control mechanism operatively associated with the shut-off unit and a drive device the control mechanism enabling the drive device to cause the at least one moving agency to propel the training device when the shut-off unit is mated with the opening and a first sensor operatively associated with the control mechanism.

In another embodiment of the methods, the control mechanism is configured to enable the drive device to cause the at least one moving agency to propel the training device in a direction associated with a second sensor.

In another embodiment of the methods, the control mechanism is configured to enable the drive device to cause the at least one moving agency to stop propelling the training device when a distance between the first sensor and a second sensor falls below a predetermined minimum distance value.

In another embodiment of the methods, the control mechanism is configured to enable the drive device to cause the at least one moving agency to propel the training device towards a second sensor when a distance between the first sensor and the second sensor exceeds a predetermined separation value.

In another embodiment of the methods, the providing further includes a motion-control device configured to cause the device to move in a random movement pattern.

In another embodiment of the methods, the shut-off unit comprises a visual enhancement.

In another embodiment of the methods, the visual enhancement is a flag, a two-dimensional graphic or a three-dimensional graphic.

In another embodiment of the methods, the visual enhancement is a three-dimensional graphic that resembles a rabbit.

In another embodiment of the methods, the providing further includes a motion-control device configured to cause the training device to move in a movement pattern that mimics a movement pattern of a rabbit.

In another embodiment of the methods, the visual enhancement is a flag and wherein the height of the flag is adjustable.

In another embodiment of the methods, the providing further includes a memory unit operatively associated with the drive device, wherein the memory unit is configured to store movement data associated with the device.

In another embodiment of the methods, the providing further includes a movement selector operatively associated with the drive device.

In another embodiment of the methods, the providing further a memory unit operatively associated with the drive device and the movement selector, wherein the memory unit is configured to store movement data associated with the device and the movement selector is configured to allow a user to select a movement pattern stored in the memory unit.

In another embodiment of the methods, the device is configured to allow a user to select from a plurality of difficulty settings.

In another embodiment of the methods, the first sensor is configured to detect a stationary or slow-moving object in its current path and wherein the drive device is configured to cause the at least one moving agency to stop or change direction upon the detection.

In another embodiment of the methods, the device is configured such that movement data is capable of being transferred from the memory unit to a computer.

Another embodiment includes a method of providing a training device comprising:

a housing comprising an on/off switch, wherein the housing is operatively associated with at least one moving agency; a first sensor associated with the housing; a drive device operatively associated with the at least one moving agency; and a control mechanism operatively associated with the first sensor and the drive device the control mechanism configured to enable the drive device to cause the at least one moving agency to propel the training device towards or away from a second sensor when the on/off switch is set to an "on" position.

In another embodiment of the methods, the control mechanism is configured to stop propelling the device when the distance between the first and second sensors (a) falls below a predetermined separation value, or (b) exceeds a predetermined separation value.

Another embodiment includes a method of providing a training device comprising: a housing comprising an opening and operatively associated with at least one moving agency; a first sensor associated with the housing; a drive device operatively associated with the at least one moving agency; a control mechanism operatively associated with the first sensor, and the drive device, and a visual enhancement removably associated with the opening and comprising a motion-control device configured to cause the device to change directions in one or more preselected movement patterns and/or propel the device at one or more predetermined speeds and such that when the visual enhancement is removably mated with the opening the control mechanism is configured to enable the drive device to cause the at least one moving agency to propel the training device in a direction away from a second sensor when a distance value between the first and second sensors is below a predetermined separation value.

Unless otherwise indicated, all numbers expressing quantities of time, distance, angles, and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

The terms "a," "an," "the" and similar referents used in the context of describing the invention (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Certain embodiments of this invention are described herein. Of course, variations on these described embodiments will become apparent to those of ordinary skill in the art upon reading the foregoing description. The inventor expects skilled artisans to employ such variations as appropriate, and the inventors intend for the invention to be practiced otherwise than specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

Furthermore, numerous references have been made to patents and printed publications throughout this specification.

Each of the above-cited references and printed publications are individually incorporated herein by reference in their entirety.

In closing, it is to be understood that the embodiments of the invention disclosed herein are illustrative of the principles of the present invention. Other modifications that may be employed are within the scope of the invention. Thus, by way of example, but not of limitation, alternative configurations of the present invention may be utilized in accordance with the teachings herein. Accordingly, the present invention is not limited to that precisely as shown and described.

What is claimed is:

1. A training device comprising:

a housing comprising an opening, wherein said housing is operatively associated with at least one moving agency, a shut-off unit removably mated with the opening, a control mechanism operatively associated with the shut-off unit and a drive device said control mechanism enabling the drive device to cause the at least one moving agency to propel the training device when the shut-off unit is mated with the opening, and a first sensor operatively associated with the control mechanism, wherein the control mechanism is configured to enable the drive device to cause the at least one moving agency to: (1) stop propelling the training device when a distance between the first sensor and a second sensor falls below a predetermined separation value; (2) propel the training device away from the second sensor when a distance between the first sensor and the second sensor falls below a predetermined separation value; (3) stop propelling the device when the distance between the first and second sensors exceeds a predetermined separation value; and/or (4) propel the training device towards a second sensor when a distance between the first sensor and the second sensor exceeds a predetermined separation value.

2. The device of claim 1, wherein the control mechanism is further configured to enable the drive device to cause the at least one moving agency to propel the training device in a direction associated with the second sensor when not stopping or propelling based on options (1)-(4) of claim 1.

3. The device of claim 1, further comprising a motion-control device configured to cause the device to move in a random movement pattern.

4. The device of claim 1 wherein the shut-off unit comprises a visual enhancement.

5. The device of claim 4, wherein the visual enhancement is a flag, a two-dimensional graphic or a three-dimensional graphic.

6. The device of claim 5, wherein the visual enhancement is a three-dimensional graphic that resembles a rabbit.

7. The device of claim 6, further comprising a motion-control device configured to cause the training device to move in a movement pattern that mimics a movement pattern of a rabbit.

8. The device of claim 4, wherein the visual enhancement is a flag and wherein the height of the flag is adjustable.

9. The device of claim 1 further comprising a memory unit operatively associated with the drive device, wherein the memory unit is configured to store movement data associated with the device.

10. The device of claim 1 further comprising a movement selector operatively associated with the drive device.

11. The device of claim 10 further comprising a memory unit operatively associated with the drive device and the movement selector, wherein the memory unit is configured to store movement data associated with the device and the movement selector is configured to allow a user to select a movement pattern stored in the memory unit.

12. The device of claim 1, wherein the device is configured to allow a user to select from a plurality of difficulty settings.

13. The device of claim 1, wherein the first sensor is configured to detect a stationary or slow-moving object in its current path and wherein the drive device is configured to cause the at least one moving agency to stop or change direction upon said detection.

14. The device of claim 9, wherein the device is configured such that movement data is capable of being transferred from the memory unit to a computer.

15. A training device comprising:

a housing comprising an on/off switch, wherein said housing is operatively associated with at least one moving agency;

a first sensor associated with the housing;

a drive device operatively associated with the at least one moving agency; and a control mechanism operatively associated with the first sensor and the drive device said control mechanism enabling the drive device to cause the at least one moving agency to propel the training device towards and/or away from a second sensor when the on/off switch is set to an "on" position;

wherein the control mechanism is configured to enable the drive device to cause the at least one moving agency to: (1) stop propelling the training device when a distance between the first sensor and a second sensor falls below a predetermined separation value; (2) propel the training device away from the second sensor when a distance between the first sensor and the second sensor falls below a predetermined separation value; (3) stop propelling the device when the distance between the first and second sensors exceeds a predetermined separation value; and/or (4) propel the training device towards a second sensor when a distance between the first sensor and the second sensor exceeds a predetermined separation value.

16. A training device comprising:

a housing comprising an opening and operatively associated with at least one moving agency;

a first sensor associated with the housing;

a drive device operatively associated with the at least one moving agency;

a control mechanism operatively associated with the first sensor, and the drive device, and a a visual enhancement removably associated with the opening and comprising a motion-control device configured to cause the device to change directions in one or more preselected movement patterns and/or propel the device at one or more predetermined speeds and such that when the visual enhancement is removably mated with the opening wherein the control mechanism is configured to enable the drive device to cause the at least one moving agency to: (1) stop propelling the training device when a distance between the first sensor and a second sensor falls below a predetermined separation value; (2) propel the training device away from the second sensor when a distance between the first sensor and the second sensor falls below a predetermined separation value; (3) stop propelling the device when the distance between the first and second sensors exceeds a predetermined separation value; and/or (4) propel the training device towards a second sensor when a distance between the first sensor and the second sensor exceeds a predetermined separation value.

17. The device of claim 15, further comprising a motion-control device configured to cause the device to move in a random movement pattern.

18. The device of claim 15 wherein the housing is associated with a visual enhancement.

19. The device of claim 18, wherein the visual enhancement is a flag, a two-dimensional graphic or a three-dimensional graphic.

20. The device of claim 19, wherein the visual enhancement is a three-dimensional graphic that resembles a rabbit.

21. The device of claim 20, further comprising a motion-control device configured to cause the training device to move in a movement pattern that mimics a movement pattern of a rabbit.

22. The device of claim 18, wherein the visual enhancement is a flag and wherein the height of the flag is adjustable.

23. The device of claim 15 further comprising a memory unit operatively associated with the drive device, wherein the memory unit is configured to store movement data associated with the device.

24. The device of claim 15 further comprising a movement selector operatively associated with the drive device.

25. The device of claim 24 further comprising a memory unit operatively associated with the drive device and the movement selector, wherein the memory unit is configured to store movement data associated with the device and the movement selector is configured to allow a user to select a movement pattern stored in the memory unit.

26. The device of claim 15, wherein the device is configured to allow a user to select from a plurality of difficulty settings.

27. The device of claim 15, wherein the first sensor is configured to detect a stationary or slow-moving object in its current path and wherein the drive device is configured to cause the at least one moving agency to stop or change direction upon said detection.

28. The device of claim 23, wherein the device is configured such that movement data is capable of being transferred from the memory unit to a computer.

29. The device of claim 15, wherein the control mechanism is configured to enable the drive device to cause the at least one moving agency to stop propelling the training device when one or more of a diagnostic of the trainee attains, surpasses, or falls below a particular level, threshold, and/or rate, and/or after one or more diagnostics has been maintained at a particular level over a period of time.

30. The device of claim 15, wherein the control mechanism is further configured to enable the drive device to cause the at least one moving agency to propel the training device in a direction associated with the second sensor when not stopping or propelling based on options (1)-(4) of claim 15.

31. The device of claim 16, wherein the control mechanism is configured to enable the drive device to cause the at least one moving agency to stop propelling the training device when one or more of a diagnostic of the trainee attains, surpasses, or falls below a particular level, threshold, and/or rate, and/or after one or more diagnostics has been maintained at a particular level over a period of time.

32. The device of claim 16, further comprising a motion-control device configured to cause the device to move in a random movement pattern.

33. The device of claim 16, wherein the visual enhancement is a flag, a two-dimensional graphic or a three-dimensional graphic.

34. The device of claim 33, wherein the visual enhancement is a three-dimensional graphic that resembles a rabbit.

35. The device of claim 34, further comprising a motion-control device configured to cause the training device to move in a movement pattern that mimics a movement pattern of a rabbit.

36. The device of claim 16, wherein the visual enhancement is a flag and wherein the height of the flag is adjustable.

37. The device of claim 16 further comprising a memory unit operatively associated with the drive device, wherein the memory unit is configured to store movement data associated with the device.

38. The device of claim 16 further comprising a movement selector operatively associated with the drive device.

39. The device of claim 38 further comprising a memory unit operatively associated with the drive device and the movement selector, wherein the memory unit is configured to store movement data associated with the device and the movement selector is configured to allow a user to select a movement pattern stored in the memory unit.

40. The device of claim 16, wherein the device is configured to allow a user to select from a plurality of difficulty settings.

41. The device of claim 16, wherein the first sensor is configured to detect a stationary or slow-moving object in its current path and wherein the drive device is configured to cause the at least one moving agency to stop or change direction upon said detection.

42. The device of claim 37, wherein the device is configured such that movement data is capable of being transferred from the memory unit to a computer.

43. The device of claim 16, wherein the control mechanism is further configured to enable the drive device to cause the at least one moving agency to propel the training device in a direction associated with the second sensor when not stopping or propelling based on options (1)-(4) of claim 16.

44. The device of claim 1, wherein the control mechanism is configured to enable the drive device to cause the at least one moving agency to stop propelling the training device when one or more of a diagnostic of the trainee attains, surpasses, or falls below a particular level, threshold, and/or rate, and/or after one or more diagnostics has been maintained at a particular level over a period of time.

45. The device of claim 1, wherein the control mechanism is further configured to enable the drive device to cause the at least one moving agency to propel the training device towards the second sensor when a distance between the first sensor and the second sensor falls below a predetermined separation value.

46. The device of claim 15, wherein the control mechanism is further configured to enable the drive device to cause the at least one moving agency to propel the training device towards the second sensor when a distance between the first sensor and the second sensor falls below a predetermined separation value.

47. The device of claim 16, wherein the control mechanism is further configured to enable the drive device to cause the at least one moving agency to propel the training device towards the second sensor when a distance between the first sensor and the second sensor falls below a predetermined separation value.

* * * * *